US005888948A

United States Patent [19]

Meny et al.

[11] Patent Number: 5,888,948

[45] Date of Patent: Mar. 30, 1999

[54] TWO-CYCLE LUBRICATING OIL

[75] Inventors: Emil Joseph Meny, Summit; Charles F. Hoffman, Neshanic Station, both of N.J.

[73] Assignee: Exxon Chemical Patents Inc., Linden, N.J.

[21] Appl. No.: 738,428

[22] Filed: Oct. 25, 1996

[51] Int. Cl.[6] ..... C10M 143/06

[52] U.S. Cl. ..... 508/591; 508/287

[58] Field of Search ..... 508/591

[56] References Cited

U.S. PATENT DOCUMENTS

| | | | |
|---|---|---|---|
| 4,031,020 | 6/1977 | Sugiura et al. | 508/591 |
| 5,049,291 | 9/1991 | Miyaji et al. | 508/591 |
| 5,321,172 | 6/1994 | Alexander et al. | 508/591 |
| 5,330,667 | 7/1994 | Tiffany et al. | 252/49.6 |
| 5,498,353 | 3/1996 | Lin et al. | 252/33.4 |
| 5,624,890 | 4/1997 | Kagaya et al. | 508/591 |

FOREIGN PATENT DOCUMENTS

| | | | |
|---|---|---|---|
| 0 714 972 A2 | 6/1996 | European Pat. Off. | C10M 169/04 |
| 1287579 | 8/1972 | United Kingdom | C10L 1/16 |

*Primary Examiner*—Ellen M. McAvoy
*Attorney, Agent, or Firm*—John J. Mahon

[57] ABSTRACT

A two-cycle oil is disclosed comprising a high and low molecular weight polybutene polymer, solvent and mineral oil which has suitable viscosity and exhibits improved smoke performance in the JASO test.

5 Claims, No Drawings

TWO-CYCLE LUBRICATING OIL

This invention relates to a lubricant composition useful as a two-cycle oil. More particularly the invention relates to two-cycle oil characterized in that it has a significantly reduced smoke generation characteristics and suitable viscosity. Two-stroke-cycle gasoline engines now range from small, less than 50 cc engines, to higher performance engines of 200 to 500 cc. The development of such high performance engines has created the need for new twocycle oil standards and test procedures.

Two-cycle engines are lubricated by mixing the fuel and lubricant and allowing the mixed composition to pass through the engine. Various types of two-cycle oils, compatible with fuel, have been described in the art. Typically, such oils contain a variety of additive components in order for the oil to pass industry standard tests to permit use in two-cycle engines.

U.K. Patent 1,287,579 (1972) discloses the use of low and high molecular weight polyisobutylenes in two-cycle oils but the oils are not based on mineral oils.

U.S. Pat. No. 5,498,353 (1996) discloses an oil exhibiting low smoke properties but having three types of polyisobutylenes.

The present invention is based on the discovery that the proper balance of a low and high molecular weight polybutene polymers, solvent and mineral oil can provide a two-cycle engine oil exhibiting reduced smoke generation and having a desirable viscosity of less than 6,000 cps. (Brookfield at −25° C.).

Accordingly, there has been discovered a two-cycle lubricating oil composition having a Brookfield viscosity of 6,000 cps. or less at −25° comprising an admixture of the following:

a) 9 to 15% by weight of a polybutene polymer being a polybutene, polyisobutylene or a mixture of polybutenes and polyisobutylenes having a number average molecular weight of about 900 to 1500;

b) 5 to 30% by weight of a polybutene polymer having a number average molecular weight of about 200 to 250;

c) 18 to 23% of a nitrogen containing carboxylic acid lubricating oil dispersant;

d) 16 to 30% by weight of a normally liquid hydrocarbon solvent having a boiling point of up to 300° C.; and e) 20 to 40% by weight of a mineral lubricating oil having a viscosity 20–40 cSt at 40° C.

The polybutene polymer useful as component a) in the lubricating oil compositions of this invention is a mixture of poly-n-butenes and polyisobutylene which normally results from the polymerization of $C_4$ olefins and generally will have a number average (Mn) molecular weight of about 900 to 1500 with a polyisobutylene or polybutene having a number average molecular weight of about 950 to 1300 being particularly preferred for component a). Most preferable is a mixture of polybutene and polyisobutylene having a number average molecular weight of about 950. Number average molecular weight (Mn) is measured by gel permeation gchromatography. Polymers composed of 100% polyisobutylene or 100% poly-n-butene are also within the scope of this invention and within the meaning of the term "a polybutene polymer".

For component b) the polybutene polymer is the same and preferably has a Mn molecular weight of about 200–210.

A preferred polybutene polymer for either component a) or b) is a mixture of polybutenes and polyisobutylene prepared from a $C_4$ olefin refinery stream containing about 6 wt. % to 50 wt. % isobutylene with the balance a mixture of butene (cis- and trans-) isobutylene and less than 1 wt %. butadiene. Particularly, preferred is a polymer prepared from a $C_4$ stream composed of 6–45 wt. % isobutylene, 25–35 wt. % saturated butenes and 15–50 wt. % 1- and 2-butenes. The polymer is prepared by Lewis acid catalysis.

The c) component of the two-cycle oils of this invention is a lubricating oil nitrogen carboxylic dispersant present in an amount of about 18–25% by weight, preferably about 20–22% by weight. These percentages include the mineral oil carriers commonly used in the dispersant products. The active ingredient content of such dispersants is typically about 50–95% by weight.

The nitrogen-containing carboxylic dispersants include amine reaction products of hydrocarbyl-substituted carboxylic acylating agents such as substituted carboxylic acids or derivatives thereof. Typically the amines are polyamines, preferably the amines are ethylene amines, amine bottoms or amine condensates. The hydrocarbyl-substituted carboxylic acylating agent and polyamine are reacted at a temperature from about 0° C., preferably about 50° C., up to about 200° C., preferably up to about 150° C. Usually an equivalent of acylating agent is reacted with 1–4 equivalents of polyamine, preferably 24 equivalents.

The hydrogen-substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc., preferably acid, esters or anhydrides, more preferably anhydrides. Preferably the carboxylic acylating agent is a succinic acylating agent.

The hydrocarbyl-substituted carboxylic acylating agent includes agents which have a hydrocarbyl group derived from a polyalkene. The polyalkene is characterized as containing from at least about 8 carbon atoms, preferably at least about 30, more preferably at least 35 up to about 300 carbon atoms, preferably 200, more preferably 100. In one embodiment, the polyalkene is characterized by an Mn (number average molecular weight) value of at least about 500. Generally, the polyalkene is characterized by an Mn value of about 500 to about 5000, preferably about 800 to about 2500. In another embodiment Mn varies between about 500 to about 1200 or 1300.

Preferred for use in the oils of this invention are polyisobutenyl succinimide dispersants where the polyisobutenyl group has an Mn of about 950 or about 450 and mixtures of same with a dispersant formed by reacting isostearic acid, tetraethylene pentamine and maleic anhydride.

The polyalkenes include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the interpolymer is a homopolymer. An example of a preferred homopolymer is a polybutene, preferably a polybutene in which about 50% of the polymer is derived from isobutylene. The polyalkenes are prepared by conventional procedures.

The hydrocarbyl-substituted carboxylic acylating agents are prepared by a reaction of one or more polyalkenes with one or more unsaturated carboxylic reagent. The unsaturated carboxylic reagent generally contains an alpha-beta olefinic unsaturation. The carboxylic reagents may be carboxylic acids per se and functional derivatives thereof, such as anhydrides, esters, amides, imides, salts, acyl halides, and nitriles. These carboxylic acid reagents may be either monobasic or polybasic in nature. When they are polybasic they are preferably dicarboxylic acids, although tri- and tetracarboxylic acids can be used. Specific examples of useful monobasic unsaturated carboxylic acids are acrylic acid, methacrylic acid, cinnamic acid, crotonic acid, 2-phenylpropenoic acid, etc. Exemplary polybasic acids include maleic acid, fumaric acid, mesaconic acid, itaconic acid and citraconic acid. Generally, the unsaturated carboxylic acid or derivative is maleic anhydride or maleic or fumaric acid or ester, preferably, maleic acid or anhydride, more preferably maleic anhydride.

The solvents useful in the present invention as the d) component may generally be characterized as being normally liquid petroleum or synthetic hydrocarbon solvents having a boiling point not higher than about 300° C. at atmospheric pressure. Such a solvent must also have a flash point in the range of about 60°–120° C. such that the flash point of the two-cycle oil of this invention is greater than 70° C. Typical examples include kerosene, hydrotreated kerosene, middle distillate fuels, isoparaffinic and naphthenic aliphatic hydrocarbon solvents, dimers, and higher oligomers of propylene butene and similar olefins as well as paraffinic and aromatic hydrocarbon solvents and mixtures thereof. Such solvents may contain functional groups other than carbon and hydrogen provided such groups do not adversely affect performance of the two-cycle oil. Preferred is an aliphatic hydrocracked light hydrocarbon distillate having a boiling point range of about 199°–288° C. and a viscosity of 1.71 cSt at 40° C.

The e) component of the lubricating compositions of this invention is a hydrocarbon mineral oil of lubricating viscosity, that is, a viscosity of about 55–180 cSt at 40° C.

Suitable oils include mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Oils of this invention may also contain small proportions of various special purpose conventional lubricating oil additives.

Additional conventional additives for lubricating oils which may be present in the composition of this invention include viscosity modifiers, corrosion inhibitors, oxidation inhibitors, friction modifiers, dispersants, antifoaming agents, antiwear agents, pour point depressants, detergents, rust inhibitors and the like.

Typical oil soluble viscosity modifying polymers will generally have weight average molecular weights of from about 10,000 to 1,000,000 as determined by gel permeation chromatography.

Corrosion inhibitors are illustrated by phosphosulfurized hydrocarbons and the products obtained by reacting a phosphosulfurized hydrocarbon with an alkaline earth metal oxide or hydroxide.

Oxidation inhibitors are antioxidants exemplified by alkaline earth metal salts of alkylphenol thioesters having preferably $C_5$–$C_{12}$ alkyl side chain such as calcium nonylphenol sulfide, barium t-octylphenol sulfide, dioctylphenylamine as well as sulfurized or phospho sulfurized hydrocarbons. Also included are oil soluble antioxidant copper compounds such as copper salts of $C_{10}$ to $C_{18}$ oil soluble fatty acids.

Friction modifiers include fatty acid esters and amides, glycerol esters of dimerized fatty acids and succinate esters or metal salts thereof.

Pour point depressants also known as lube oil flow improvers can lower the temperature at which the fluid will flow and typical of these additives are $C_8$–$C_{18}$ dialkyl fumarate vinyl acetate copolymers, polymethacrylates and wax naphthalene.

Foam control can also be provided by an anti foamant of the polysiloxane type such as silicone oil and polydimethyl siloxane.

Anti-wear agents reduce wear of metal parts and representative materials are zinc dialkyidithiophosphate and zinc diaryl diphosphate.

Detergents and metal rust inhibitors include the metal salts of sulfonic acids, alkylphenols, sulfurized alkylphenols, alkyl salicylates, naphthenates and other oil soluble mono and dicarboxylic acid. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur.

Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

The oils of this invention are prepared by simply combining the aforesaid ingredients at room temperature and a further aspect of this invention are oils prepared by mixing together the aforesaid ingredients a), b), c), d) and e).

A particular advantage of this invention is that the use of the relatively low molecular weight polymer, i.e., the polybutene polymer having a Mn of about 200–250, especially 200–210, allows the formulation of oils having a Brookfield viscosity of less than 6,000 cps (−25° C.) such as about 1,500 to 3,000 cps and exhibiting substantially improved smoke performance over oils with similar components absent the low molecular weight polybutene polymer. Use of this polymer enables the formulation to function effectively without the customary relatively high amounts of high molecular weight polybutene and solvent which are considered to negatively impact smoke generation of two-cycle oils.

The lubricating oil compositions of the present invention will mix freely with the fuels used in such two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline as defined by ASTM specification D439-73. Such fuels can also contain non-hydrocarbonaceous materials such as alcohols, ethers, organo nitro compounds and the like, e.g., methanol, ethanol, diethyl ether, methylethyl ether, nitro methane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitro methane, etc. When gasoline is used as preferred than the mixture of the hydrocarbons having an ASTM boiling point of 60° C. at the 10% distillation point to about 205° C. at the 90% distillation point.

The lubricants of this invention are used in admixture with fuels in amounts of about 20 to 250 parts by weight of fuel per 1 part by weight of lubricating oil, more typically about 30–100 parts by weight of fuel per 1 part by weight of oil.

The invention is further illustrated by the following examples which are not to be considered as limitative of its scope.

EXAMPLES

Three oils were evaluated for smoke generation properties in accordance with the JASO M345 test procedures JASO M340, M341, M342 and M343. This is an engine test established by society of Automotive Engineers of Japan (JSAE) for two-cycle gasoline engine oils. As of Jul. 1, 1994, oils used in two-cycle engines are being labeled in accordance with the JASO-M345 standards as announced by the Japan Automobile Standards Organization (JASO). JASO published the JASO M345 standards in April, 1994.

One of these tests (M342) involves a procedure to measure the formation of exhaust smoke during part of a test cycle. The result is expressed as a Smoke Index and is internally referenced against a standard two-stroke oil ranked with a Smoke Index of 100. The higher the Smoke Index the greater is the reduction in smoke emission. The test uses a 70 cc, Suzuki Generator SX 800 R. The test of smoke formation is run on a SUZUKI 70 cc two-stroke engine fitted with a generator by using a premixed fuel of gasoline and oil at the Volume ratio of 10:1. Before running the test the exhaust pipe of the engine should be covered by a muffler made of glass wool. Operate the engine under a high load of 60 Hz/800 W, and heated by the engine exhaust to remove any remaining oil deposits from the exhaust pipe. The engine is then stopped and allowed to cool, in the meantime the muffler is removed. The engine is started and operated at 50 Hz/no load (0 W) for 20 minutes. Then the engine is loaded to 50 Hz/700 W and operated. The maximum exhaust smoke density is measured by a smoke meter. The smoke index of the candidate oil is calculated by defining the smoke index of the reference oil as 100.

Two-Cycle Oils Tested

| Comparison | EC35373 | EC35365 (Comparison) | EC35364 | EC35374 (Comparison) |
|---|---|---|---|---|
| Dispersant | 22% | 22% | 22% | 22% |
| PIB 1300 or 950 Mn | 15% (1300) | 7.5% (1300) | 7.5% (950) | 15% (1300) |
| PIB 200–210 Mn | 10% | None | 10% | None |
| Solvent | 30% | 30% | 30% | 15% |
| Mineral Oil | 22.5% | 32% | 22% | 39.5% |
| LOFI | 0.5% | 0.5% | 0.5% | 0.5% |
| Polyol Ester | — | 8% | 8% | 8% |
| | 100% | 100% | 100% | 100% |
| Brookfield Viscosity, cps., −25° C. | 2,830 | 2,330 | 1,600 | 29,950 |
| Smoke Index - JASO | 133 | 96 | 102 | 87 |

Oils EC35365 and EC35374 are for the purpose of comparison and show the improvement in viscosity and smoke index attributable to the use of the low molecular weight polymer (PIB=polyisobutylene). The passing value for the JASO Smoke Index is at least 85, and values in excess of 100 are considered excellent.

Dispersant: Mixture of 14% polyisobutenyl (Mn 950) succinimide with (i) 8% polyisobutenyl (Mn 450) succinimide in oils EC 35373 and 35365 and (ii) 4% polyisobutenyl (Mn 450) succinimide and 4% isostearic acid tetraethylene polyamine and maleic anhydride reaction product in Oils EC 35364 and EC 35374.

Solvent: Aliphatic hydrocarbon hydrocracked distillate, b.p. 199°–288° C. and viscosity 1.71 cSt at 40° C.

LOFI: Dialkyl fumarate/vinyl acetate copolymer (Lube Oil Flow Improver).

Polyol Ester: Pentaerythritol ester of mixed $C_8$–$C_{10}$ monocarboxylic acids.

Mineral Oil: Solvent extracted neutral oil, 8.0 cSt at 100° C.

What is claimed is:

1. A two-cycle lubricating oil composition having a Brookfield viscosity of at least 6,000 cps at −25° C. and exhibiting a JASO Smoke Index of at least 85 which comprises an admixture of the following:

a) 9 to 15% by weight of a polybutene polymer having a Mn of about 900 to 1500;

b) 5 to 30% by weight of a polybutene polymer having a Mn of about 200 to 250;

c) 18 to 23% of a nitrogen containing carboxylic acid lubricating oil dispersant;

d) 16 to 20% of a normally liquid solvent having a boiling point up to 300° C.; and e) 20 to 40% by weight of a mineral lubricating oil having a viscosity of 20–40 cSt at 40° C.

2. The composition of claim 1 wherein there is present about 10% of said b) component having a Mn of about 200–210.

3. The composition of claim 1 wherein the Brookfield viscosity is about 1500 cps to 3000 cps.

4. The composition of claim 1 wherein the a) component has a Mn of 950 or 1300.

5. The composition of claim 1 wherein the JASO Smoke Index is reater than 100.

* * * * *